United States Patent [19]

Nowak

[11] 4,076,993

[45] Feb. 28, 1978

[54] ION SOURCE FOR HIGH INTENSITY ION BEAM

[76] Inventor: Karl Nowak, Mollard gasse 8, A 1060 Vienna 6, Austria

[21] Appl. No.: 494,400

[22] Filed: Aug. 1, 1974

[30] Foreign Application Priority Data

Aug. 13, 1973 Austria ..... 7092/73

[51] Int. Cl.[2] ..... H05H 5/02

[52] U.S. Cl. ..... 313/360; 313/361; 313/362

[58] Field of Search ..... 313/361, 362, 360; 250/296; 176/1

[56] References Cited

U.S. PATENT DOCUMENTS

| | | | |
|---|---|---|---|
| 3,155,826 | 11/1964 | Peters | 313/361 X |
| 3,271,556 | 9/1966 | Harris | 313/362 X |
| 3,296,481 | 1/1967 | Peters | 313/361 X |

*Primary Examiner*—Palmer C. Demeo

[57] ABSTRACT

The invention ion source, capable of delivering high currents, utilizes a thermionic beam - emitted from a hot cathode - which is deflected by a deflection magnet and directed into the gas to be ionized or into a vaporous atmosphere. The atomic ions, that are the result of the ionization, move in the direction opposite that of the ionizing thermionic beam, but they are hardly influenced by the deflection magnet, due to their greater mass and leave the ion source as an ion beam.

5 Claims, 1 Drawing Figure

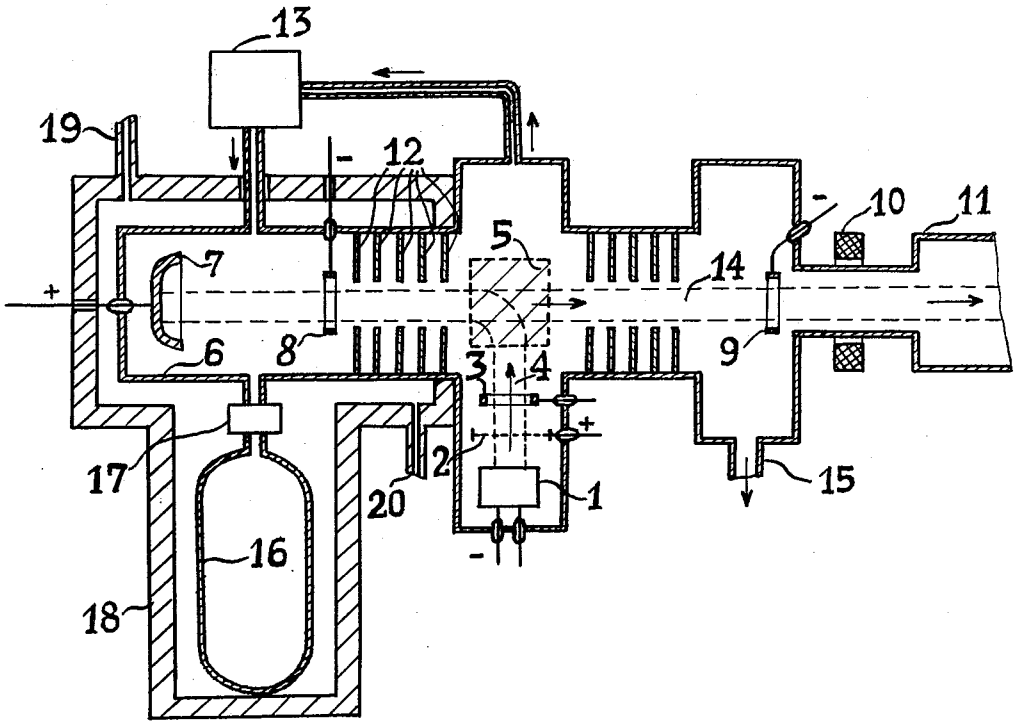
11
10
15
14
9
1
4
5
3
2
20
12
13
8
16
7
6
17
18
19

ION SOURCE FOR HIGH INTENSITY ION BEAM

The present invention relates to an ion source, especially for high beam current intensity, consisting in that an electron current generated by an electron source is directed to pass through a magnetic deflection field and then creates ionization in a gas volume, the atomic ions thus produced moving within an acceleration field in the direction opposite to the motion of electrons, and this ion current, influenced by the deflection magnet up to a small degree only, leaving the ion source as an ion beam. Moreover, in accordance with the present invention it is preferable to provide for supercooling said ion source by means of an intense cooling plant in connection with a coolant for the purpose of keeping Brownian motion within the ion current at a reduced level.

While difficulties have been resulting so far with designing ion sources for higher grade currents, and up to now commercial ion sources have comprised about between 1 and 10 milliamperes, equipment of up to 500 mA being possible at considerable cost, and ion currents of more than 1 amp. not yet generally used or available only for supply of impulsive current, the ion source under this invention provides the possibility of producing ion currents of high level, e.g. of 10 amps and more, at relatively modest cost. Such ion sources may be used, for example, to advantage for ion accelerators.

The sole FIGURE of the drawing shows an ion source according to the invention.

The drawing shows the ion source as per the invention with hot cathode 1, deflection magnet 5, the gas filled chamber 6 with anode 7 and a negative electrode 8 opposite anode 7, which serves to accelerate generated ions in the gas filled space through electron impulses. For impeding the passing over of gas into that part of the chamber which contains the hot cathode there are arranged screens or sectional walls 12, with perforations for the motion of particles. The ion current leaves the ion source as beam 14 being but little influenced by the magnetic field of the deflection magnet on account of the bigger mass of ions.

In the review BULLETIN of the Swiss Association for Electrical Engineering, copy no. 7 of 1972, pp. 337 to 342, the applicant hereof has described an arrangement for energy supply by means of nuclear fusion. The atomic ion source as per the present invention is of particular advantage for such an arrangement suitable for the construction of fusion power plants.

The invention is explained more in detail by making reference to the drawing enclosed. 1 designates a hot cathode preceded by a latticed anode 2 used for acceleration of the electron current. 3 denotes a ring-shaped electrode which, having a positive potential, may either be employed in lieu of or with latticed anode 2, or, having a negative potential, may serve to concentrate the outgoing electron current. However, if need be, this electron beam may also be magnetically contracted by a surrounding ring coil not shown. The resulting electron beam 4 is then deflected by a deflection magnet 5. The magnet 5 provides a transversal magnet field between two pole surfaces the extent of which has been shown on the drawing by way of hatching. As indicated, the direction of electron beam 4 is changed within that transversal magnetic field.

The deflected electron beam 4 reaches then a gas volume 6 holding the gas to be ionized, for instance deuterium gas. The electrons move to an anode 7, simultaneously ionizing the gas. This creates more electrons also flowing to anode 7 but atomic ions as well moving in the opposite direction to the electron current within an electric acceleration field. This field extends between anode 7 and a ring-shaped or latticed electrode 8, having a negative potential in front of anode 7. The potential between anode 7 and electrode 8 ranges in size about from 20 to 100 Volts or considerably beyond that range while the potential between hot cathode 1 and either anode electrode 2 or electrode 3 may be of similar size or, for practical reasons, of considerably larger power, for instance ranging from hundreds to thousands of Volts. A high potential may likewise be built up between cathode 1 and anode 7.

The atomic ions accelerated by the negative acceleration electrode stay first within the electron beam range, but hardly influenced because of their larger mass as compared to electrons by the deflection magnet 5, they do not reach cathode 1 and pursue an axial course, an effect that may be considerably increased by providing a further acceleration electrode at the rear right of deflection magnet 5. The ion beam arrives therefore, suitably accelerated by an additional electrode 9 having a higher negative Potential, and, if need be, magnetically contracted also by a ring coil 10, to an outlet of the ion source, separated from the cathode region, and may then be drawn from there so as to be fed, for example, to the attachment element 11 of an ion accelerator.

The drawing shows gas volume 6 separated from the cathode region by some type of sectional system providing 12 consecutive chambers formed by walls, and having a central aperture for the passage of particle beams. Such subdivisions have proved suitable as an impediment to the gas filling leaving volume 6. It is deemed proper to contain the pressure within gas vessel 6 at the size of some millimeters of mercury, so e.g. between 10 and 30 mm of mercury and more. Under such conditions, considerably less pressure will be present in the hot cathode 1 region, constantly reduced by a vacuum pump 13 able to remove and compress, recycling the gas drawn off to gas volume 6. However, it is useful to provide within the region of hot cathode 1 not a complete high vacuum but only a relatively low gas pressure of about tenth of a Torr. It is equally proper to install a similar chamber system in the further course taken by ion beam 14, and following that equipment a highly exhausted space having a suction line 15 may be made available with the effect that the ion beam can be directed to an accelerator, virtually in the absence of any accompanying gas flow.

From a gas bottle 16 via a pressure governor 17 a filling pressure as constant as possible is assured for gas volume 6. Filler gas bottle and gas volume 6 are mounted in that area within a closed heat insulation 18 forming a cavity through which a coolant, e.g. fluid helium, may pass by use of in - and outlet lines 19 and 20. This feature permits to communicate the least possible speed component of Brownian motion to the atomic ions produced, a factor of essential importance for obtaining high densities and a uniform speed of the ions involved.

The conclusive advantage of the new arrangement is, the one hand, the possibility of obtaining ionic currents of virtually unlimited intensity since they essentially depend solely on the size of the ionizing electronic current and are obtainable within the size range thereof. While in normal canal ion beam tubes only a fraction of the ionic current can be tread out, in the present case the entire ionic current may be subjected to ionization, and amounts, as already mentioned, to the size of the electronic current itself. Therefore, the ionic current production is of high efficiency. On the other hand, an additional possibility is to free ions with low thermal motion. Moreover, life of the hot cathode is more durable since no impact of ions occurs. If the hot cathode is affected by the gas filling, an effect possible in part with the use of deuterium, the hot cathode region may also be highly evacuated. To this effect, it would be possible to arrange also between electrode 3 and deflection magnet 5 an additional junction element containing another chamber system with partition walls 12, and to equip the hot cathode region with a special high vacuum intake.

As to the dimensions of the new ion source, they will depend on the working conditions, especially on the required intensity of the ionic current. For a 10 amps ionic current, the beam diameter may be for example about 12 cms, that is within a size of 10 cms. In the event of 100 amps ionic current, a beam diameter of about 40 cms should be reckoned with. The above values could be reduced by means of known measures resulting in contraction. The tube sizes will then have to be adapted to such conditions under the aspects already known, and to properly applied chilling that may be preferably a supercooling action on the entire ion source but said sizes are also a function of the applied voltage potentials falling within the range of an hundred up to thousands of Volts. The full length of the equipment may vary in size from decimeters to meters, for instance in accordance with the FIGURE shown.

With respect to working conditions, it should be pointed out that for instance an electron beam 4 of 10 amps may produce by means of ionization an ionic beam of approximately that size with the result that for example also an ionic current 14 of 10 amps will occur so that a total of close to 20 amps electron current flows to anode 7.

I claim:

1. An ion source for producing a high intensity ion beam comprising an evacuable chamber, a hot cathode (1) and an anode (7) supported within said chamber in spaced relationship to each other, a plurality of spaced, perforated, dividing walls (12) supported within said chamber between said hot cathode and said anode and in spaced relationship to said cathode and said anode, a deflection magnet including magnetic pole pieces (5) adjacent said chamber near the space between said hot cathode and said plurality of walls and means for introducing a gas between said anode and said plurality of walls.

2. An ion source as per claim 1 with the evacuable chamber being constructed such that the hot cathode (1) is not in the beam direction of anode (7) leading through the spaced, perforated dividing walls (12), but laterally from them, so that the deflection magnet within this beam direction with his magnetic pole pieces (5) adjacent to the chamber deflects the electronic beam (4) coming from the said hot cathode in an angle against the said anode.

3. An ion source as per claim 1 with which that part of the evacuable chamber which contains the hot cathode (1) and is situated starting from anode (7) behind the space perforated dividing walls (12) is constantly evacuated by a vacuum pump (13) with the vacuum pump sucking off through lines the gas passing through the perforations of the space perforated dividing walls (12) to the gas chamber between the said walls and the said anode.

4. An ion source as per claim 1, made with a cooling jacket (18) which by means of liquid helium or a similar cooling agent heavily cools down the evacuable chamber and the gas filled into same which is between the spaced perforated dividing walls (12) and the anode (7) with the cooling agent being supplied and conducted off through tubes (19, 20).

5. An ion source as per claim 1, which contains in the evacuable chamber attached in a straight direction in succession an anode (7), an electrode (8), the spaced perforated dividing walls (12), the range of influence of the deflection magnet between the magnetic pole pieces (5), further spaced perforated dividing walls, a further electrode (9) and joining a tube (11) through which the ionic beam of high intensity can emerge.

* * * * *